US007815062B2

(12) United States Patent
Suffa

(10) Patent No.: US 7,815,062 B2
(45) Date of Patent: Oct. 19, 2010

(54) CLOSURE SYSTEM CONSTITUTED FROM A CLOSURE CAP AND A CONTAINER PART

(75) Inventor: Udo Suffa, Gefell (DE)

(73) Assignee: Alpla-Werke Alwin Lehner GmbH & Co. KG (AT)

( * ) Notice: Subject to any disclaimer, the term of this patent is extended or adjusted under 35 U.S.C. 154(b) by 640 days.

(21) Appl. No.: 11/361,917

(22) Filed: Feb. 24, 2006

(65) Prior Publication Data

US 2006/0180617 A1 Aug. 17, 2006

Related U.S. Application Data

(63) Continuation of application No. PCT/EP2004/052108, filed on Sep. 9, 2004.

(30) Foreign Application Priority Data

Sep. 23, 2003 (DE) ..... 103 44 241
Dec. 30, 2003 (DE) ..... 103 61 610
Sep. 3, 2004 (DE) ..... 10 2004 042 633

(51) Int. Cl.
*B65D 55/02* (2006.01)

(52) U.S. Cl. ..... 215/221; 215/216; 220/326

(58) Field of Classification Search ..... 215/221, 215/276, 216; 220/326
See application file for complete search history.

(56) References Cited

U.S. PATENT DOCUMENTS 3,739,934 A * 6/1973 Bruno ..... 215/216
3,901,400 A * 8/1975 Westfall ..... 215/221
3,958,709 A * 5/1976 Nixdorff ..... 215/221
4,149,646 A 4/1979 Julian ..... 215/216
4,204,615 A 5/1980 McCarthy ..... 222/153
4,413,742 A * 11/1983 Sandhaus ..... 215/216
4,782,966 A * 11/1988 Thackrey ..... 215/230
4,881,648 A * 11/1989 Hagerty ..... 206/540
4,948,002 A 8/1990 Thornock et al. ..... 215/221

(Continued)

FOREIGN PATENT DOCUMENTS

WO WO 97/23388 7/1997

(Continued)

OTHER PUBLICATIONS

International Search Report; Jul. 20, 2005; 5 pages.

*Primary Examiner*—Anthony Stashick
*Assistant Examiner*—James N Smalley
(74) *Attorney, Agent, or Firm*—St. Onge Steward Johnston & Reens LLC

(57) ABSTRACT

The invention relates to a closure system constituted of a closure cap, preferably produced by plastic injection molding, and a container part that is provided with a mouth, likewise preferably produced from a plastic material. The closure cap can be screwed onto the container part and the system is provided with a tamper evidence mechanism that has to be actuated twice to be overcome. The aim of the invention is to improve said tamper evidence mechanism and its handling. For this purpose, the tamper evidence mechanism comprises an actuation tab having a twist-lock feature and being freely cut on the closure cap, and a counter-projection. Said counter-projection can be overcome by acting upon the actuation tab and is molded onto the container upstream of the counter-thread configured on the container part.

7 Claims, 13 Drawing Sheets

U.S. PATENT DOCUMENTS

| | | | | | |
|---|---|---|---|---|---|
| 5,038,454 | A | * | 8/1991 | Thornock et al. | 29/451 |
| 5,213,223 | A | * | 5/1993 | Minnette | 215/216 |
| 5,230,433 | A | * | 7/1993 | Hamilton et al. | 215/221 |
| 5,671,853 | A | * | 9/1997 | Herr | 215/216 |
| 5,706,963 | A | * | 1/1998 | Gargione | 215/219 |
| 5,722,546 | A | * | 3/1998 | Briere | 215/216 |
| 5,735,417 | A | | 4/1998 | Darr et al. | 215/216 |
| 5,819,967 | A | | 10/1998 | Lo | 215/206 |
| 5,865,330 | A | | 2/1999 | Buono | 215/216 |
| 6,036,036 | A | * | 3/2000 | Bilani et al. | 215/216 |
| 6,112,921 | A | * | 9/2000 | Robinson | 215/216 |
| 6,296,130 | B1 | * | 10/2001 | Forsyth et al. | 215/219 |
| 6,669,048 | B2 | * | 12/2003 | Eva et al. | 220/524 |
| 2001/0013523 | A1 | | 8/2001 | Gross et al. | 222/94 |

FOREIGN PATENT DOCUMENTS

| | | |
|---|---|---|
| WO | WO 03/068611 | 8/2003 |

* cited by examiner 17
x
16
17
2
18
4
1
6
15
17
x
3

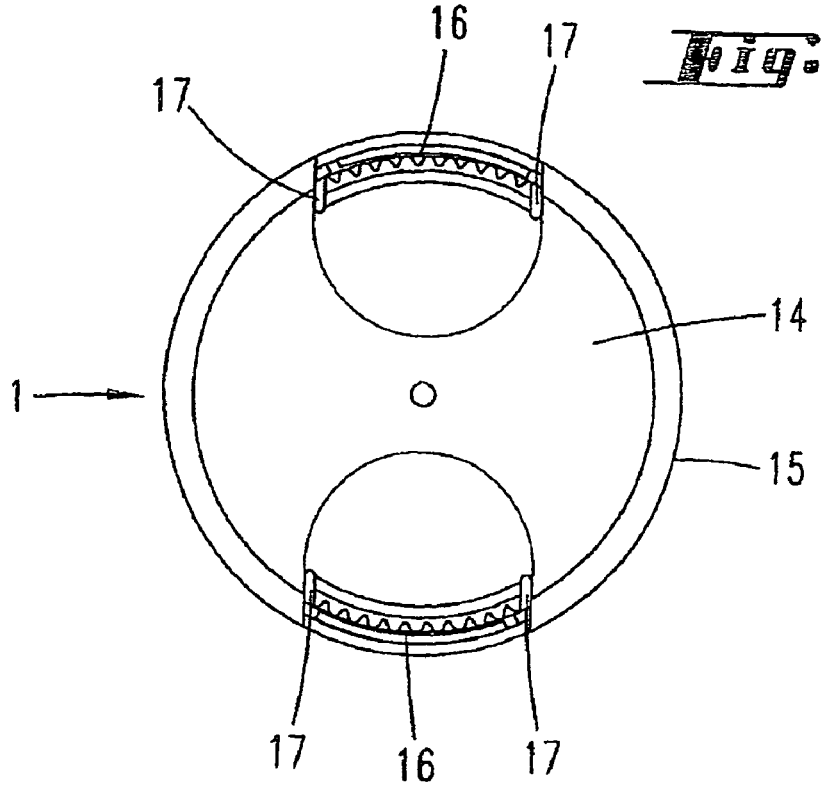
Fig. 4
Fig. 5
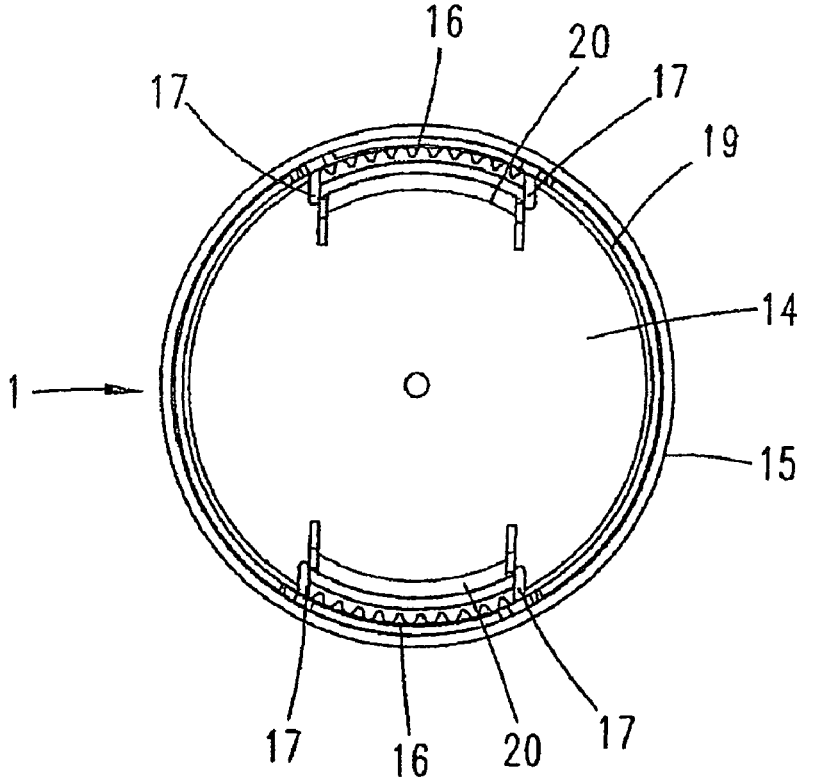

CLOSURE SYSTEM CONSTITUTED FROM A CLOSURE CAP AND A CONTAINER PART

CROSS-REFERENCE TO RELATED APPLICATIONS

The present application is a continuation of pending International patent application PCT/EP2004/052108 filed on Sep. 9, 2004 which designates the United States and which claims priority of German patent applications 10344241.3 filed on Sep. 23, 2003, 10361610.1 filed on Dec. 30, 2003 and 102004042633.3 filed on Sep. 3, 2004.

FIELD OF THE INVENTION

The invention relates to a closure combination comprising a closure cap, which is preferably produced by plastics injection molding, and a container part, which has a mouth opening likewise preferably consisting of plastics material, it being possible for the closure cap to be screw-connected to the container part, and an opening-securing means which requires two-fold actuation being provided.

BACKGROUND OF THE INVENTION

Closure combinations of the type in question are known. For the purpose of securing the closure cap on the container part, these closure combinations have shaped portions which require two-fold actuation in order for the closure cap to be released. It is thus also known for the action of the opening-securing means of the closure cap to be overcome by virtue of the cap wall being partially pressed in and subsequently rotated in the opening direction. Both the closure cap and the container part are preferably plastics-material parts, further preferably plastics injection moldings.

In respect of the given prior art, it is an object of the invention further to improve a closure combination of the type in question, in particular in terms of the opening-securing means and of handling.

SUMMARY OF THE INVENTION

This object is achieved first and foremost by the subject matter of Claim 1, this being based on the fact that the opening-securing means comprises an actuating portion of flap-like form, which has a rotary block and is cut free from the closure cap, and an opposing protrusion, over which it is possible to pass by acting on the flap-like actuating portion and which is formed above the mating thread formed on the container part. For all practical purposes, the opening is secured independently of, in any case in a spatially separate manner from, the threaded engagement between the closure cap and the container part. Since merely a cutting-free operation is necessary in order to achieve a flap-like actuating portion in the closure cap, a configuration which is advantageous in production terms is obtained at the same time.

This object is also achieved, independently of the subject matter which has already been described, by the subject matter of Claim 2, this being based on the fact that an additional part associated with the mouth is provided, this being rotationally secured on the mouth but otherwise being removable, and that the opening-securing means is formed with interaction between the closure cap and the additional part. It is thus possible to provide at the same time, by means of the additional part, a removable means of influencing the mouth, for example in the manner of a spout, but also in the manner simply of a closure part for the mouth. Since the opening-securing means is formed between the closure cap and the additional part, the container part as such does not have to contain any means of securing the opening. This also gives rise to advantageous possibilities for configuring the mouth as such.

The configurations and measures which are described hereinbelow in the manner of subclaims may also, in principle, have independent meaning in each case.

Thus, it is preferably provided that the opposing protrusion, over which it is possible to pass, is formed integrally in the region of a container-part top. The protrusion further preferably extends perpendicularly to the plane of the container-part top.

Furthermore, the opposing protrusion may be an integral constituent part of an annular wall which encloses the container-part top and, in the region of transition to the opposing protrusion—as seen in the screw-on direction of the closure cap—merges into a run-on slope. Furthermore, a plurality of uniformly distributed opposing protrusions are preferably provided over the circumference of the container-part top, for example, in relation to a plan view of the container-part top, two diametrically opposite opposing protrusions, it being possible for the number of flap-like actuating portions interacting therewith to correspond to the number of opposing protrusions. As an alternative, it is also possible to provide fewer flap-like actuating portions, for example, in the case of four opposing protrusions, two diametrically opposite flap-like actuating portions.

The abovementioned container-part top may also be formed, in functional terms, on the already mentioned additional part.

It is also proposed that, with the closure cap screwed on, a lower edge of the flap-like actuating portion is disposed above the mating thread. Correspondingly, the mating thread is formed beneath the opposing protrusion and thus beneath the actuating-part top, in the region of the actuating-part wall or annular wall. The cut-free foot portion of the flap-like actuating portion, this foot portion interacting with the opposing protrusion, engages radially behind the annular wall of the container-part top during the screw-on operation, the flap-like actuating portion or portions being moved out radially inward by the run-on slopes, formed from the annular wall, during the screw-on operation in order finally, passing over the opposing protrusion, to pass behind the latter with blocking action, so that the closure cap cannot be screwed back. The radial movement of the flap-like actuating portion and the final, automatic return displacement of the same into the blocking position are ensured by elastic properties of the plastics material selected for producing the closure cap. Corresponding to the diametric arrangement of two opposing protrusions, two diametrically opposite flap-like actuating portions are preferably also cut free in the closure cap, the incisions, furthermore, extending into the region of the closure-cap base, as a result of which the incisions each comprise a vertical portion and an approximately horizontal portion. As a result of this configuration, it is also possible to press the flap-like actuating portion or portions from above, or in any case partially from above, in order to overcome the action of the opening-securing means.

The flap-like actuating portion has a circumferential band of the closure cap gripping beneath it, this band having a threaded formation on the inside for the purpose of interacting with the mating thread of the container part, it also being possible for a flap-like actuating portion to be movable freely relative to the circumferential band. Furthermore, the flap-like actuating portion or portions, in relation to the circumferential band gripping beneath it or them, and in relation to the cap-wall portions remaining between the flap-like actuating portions in a circumferential direction of the cap, has or have a reduced radius in relation to the axis of rotation of the cap. The circumferential band, outside the flap-like actuating portion, is an integral part of a closure-cap wall, the circumferential band and the closure-cap wall preferably having the same diameter, and the circumferential band being free of incisions for the flap-like actuating portions. It also proves to be advantageous if a rotary-opening stop which forms the opposing protrusion and interacts with a peripheral edge of the flap-like actuating portion, and the action of which can be overcome only by virtue of the flap-like actuating portion being pressed in, is formed in a container-part top oriented along a horizontal.

The meshing threads of the closure cap and container part are preferably configured for a maximum screw-on rotation of the closure cap of approximately 180°. In order to define the closed position of the screwed-on closure cap here, it is further proposed that a screw-on rotary stop is formed on a vertical externally threaded wall of the container part and/or on the container-part top oriented along the horizontal. This screw-on rotary stop can interact extremely easily with a correspondingly shaped end portion of the internal thread on the closure cap. The screw-on rotary stop is positioned such that, following the stop-limited screw-on operation of the closure cap, each flap-like actuating portion has passed with blocking action behind the opposing protrusion. The closure cap is then arrested in both screw-connection directions, it being possible, by corresponding positioning of the stops, to set a clearance for movement in the arrested position. Also conceivable, however, is a configuration, in particular in the case of the screw-on rotary stop being formed in the region of the container-part top, in which the screw-on rotary stop interacts with a vertical surface of the flap-like actuating portion, that is to say further preferably with the opposite vertical surface of a flap-like actuating portion, which interacts with the rotary-opening stop or opposing protrusion over which it is possible to pass, as a result of which this flap-like actuating portion, in the closed position of the closure cap with the opening secured, is arrested between the screw-on rotary stop and the rotary-opening stop. The closure cap can only be screwed back out of this position by two-fold actuation.

If, as has already been mentioned above, an additional part is provided, the abovementioned opposing protrusion is formed on the additional part. For this purpose, the additional part is rotationally secured (against return displacement) on the mouth or on the container. The interaction between the closure cap and the additional part thus takes place, it also being readily possible for the additional part to be removed from the container, although the closure cap is nevertheless screw-connected in this way to the container part.

The additional part may be a mouth-closure part, for example in order to prevent liquids located in the container from passing out into the space between the closure cap and the outside of the mouth when not in use. It is also possible, in particular, for the mouth to be a double mouth. As a result, suitable engagement of the additional part around the double mouth gives rise to the additional part being rotationally secured relative to the container, indeed by means of the mouth configuration. The mouth, in particular if the latter is a single mouth, may also be of non-round configuration in plan view for this purpose.

The additional part may be configured for plug-on engagement over the mouth and a thread-free neck portion which adjoins in the downward direction from the mouth plane.

The additional part is, in particular, also preferably of hat-like configuration in a cross-section. The annular wall which has already been described in principle, and forms the opposing protrusion, may be integrally formed on the hat periphery here, in vertical orientation.

BRIEF DESCRIPTION OF THE DRAWINGS

The invention is additionally explained in more detail hereinbelow with reference to the accompanying drawings, which merely illustrate exemplary embodiments and in which:

FIG. 4 shows the closure cap in plan view;

FIG. 5 shows the closure cap in a bottom view;

FIG. 8 shows a partially sectional illustration taken horizontally through the opening-securing region with the closure cap screwed on;

DETAILED DESCRIPTION OF THE INVENTION

Figure 1:
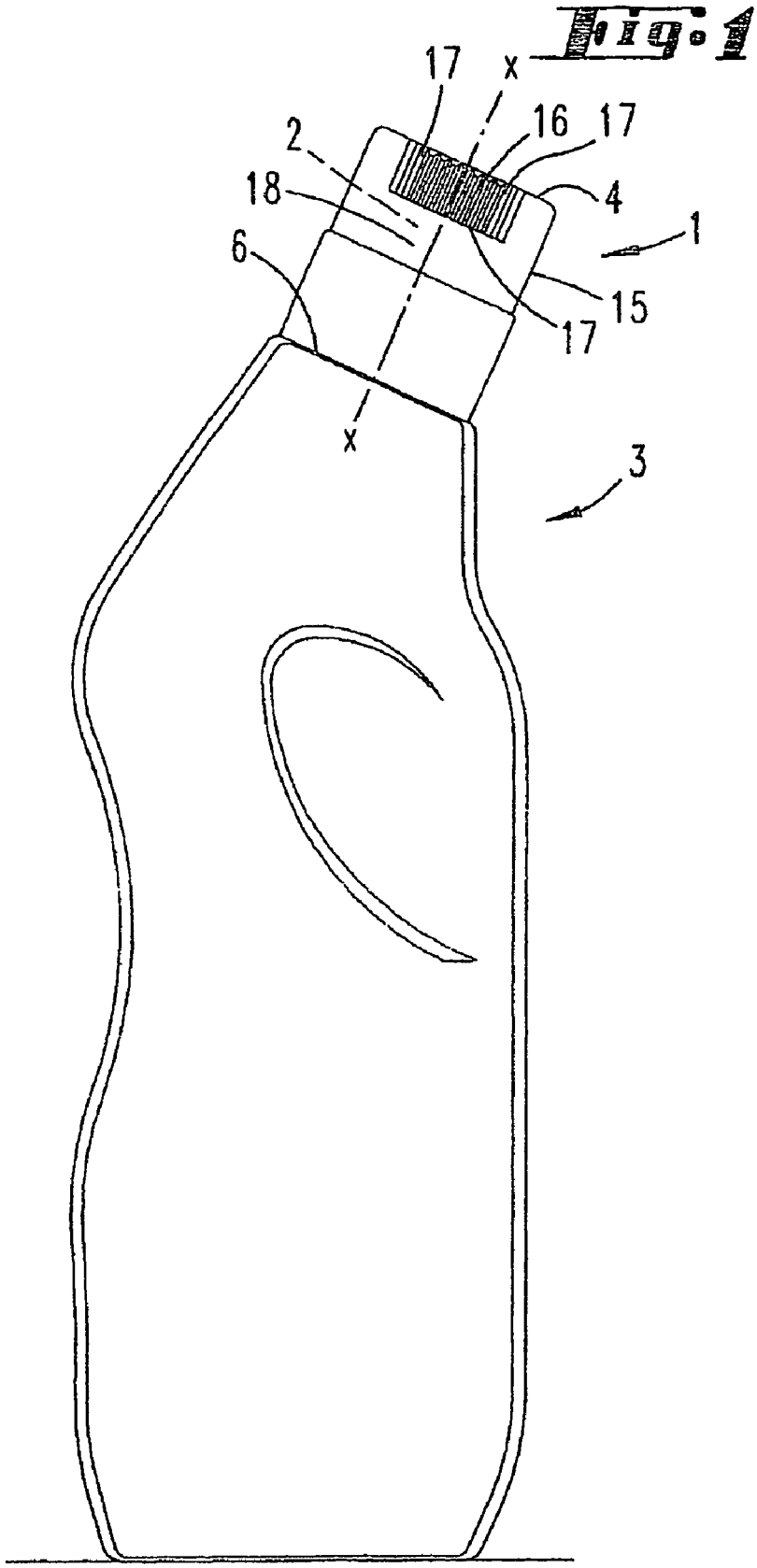
FIG. 1 shows a side view of a closure combination according to the invention comprising a closure cap and a container.

Illustrated and described, in the first instance with reference to FIG. 1, is a closure combination comprising a closure cap 1, which is preferably produced by plastics injection molding, and a container part 3, which has a mouth opening 2 likewise preferably consisting of plastics material.

The closure cap 1 can be screw-connected to the container part 3 or to a dispensing part which is snap-fitted on a neck of the container 3, an opening-securing means which requires two-fold actuation being provided.

The container part 3 or the dispensing part has an actuating-part wall 4 which carries an external thread 5. Furthermore, the container part 3 is provided with a container-part top 6 which is oriented along a horizontal and the plane of which extends transversely to a screw-on axis of rotation x. The top 6 carries the actuating wall 4, which follows the outer periphery, is configured as an annular wall 7 and, starting from the container-part top 6, extends perpendicularly to the latter.

The annular wall 7 forms in an integral manner two diametrically opposite, radially inwardly oriented opposing protrusions 8. As seen in the screw-on direction, a run-on slope 9, which is likewise formed integrally from the annular wall 7, is provided in front of each opposing protrusion 8.

Figure 9:
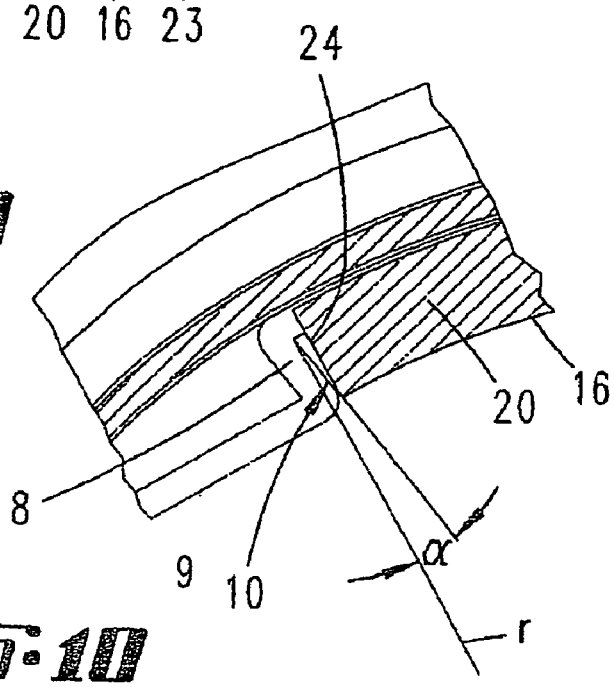
FIG. 9 shows the enlargement of the region IX in FIG. 8.

The opposing protrusions 8, which each form a rotary-opening stop 10, may be directed strictly radially in the direction of the axis of rotation x passing through the container-part top 6 in the center. A preferred configuration, however, is one in which the opposing protrusions 8 are inclined by approximately 10° in the screw-on direction beyond an imaginary line r which is radial with reference to the axis of rotation x (see angle $\alpha$ in FIG. 9). There is no run-on slope formed by this undercut in the screw-on direction.

Figure 2:
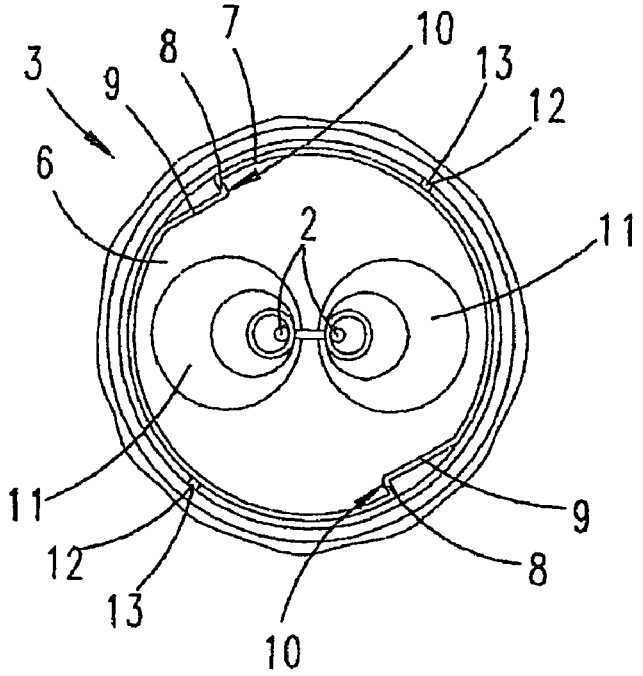
FIG. 2 shows the plan view of the container part with a mouth opening following removal of the closure cap.

The exemplary embodiment illustrated in FIG. 2 provides two mouth openings 2 which are formed on elevations 11 extending from the container-part top 6. It is also conceivable to have a configuration according to FIG. 6, in which a central mouth opening 2 is provided and in which the annular wall 7 is extended as compared to the exemplary embodiment in FIG. 2, as seen in the axial direction, and the external thread 5 is disposed on the outside of this annular wall 7, it also being the case that the constrictions in the annular wall 7 which are formed by the opposing protrusions 8 and the run-on slopes 9 extend over the entire height of the annular wall 7 and thus interrupt the external thread 5 in these regions, although this does not result in any adverse affects during the operation of screwing on the closure cap 1.

Figure 6:
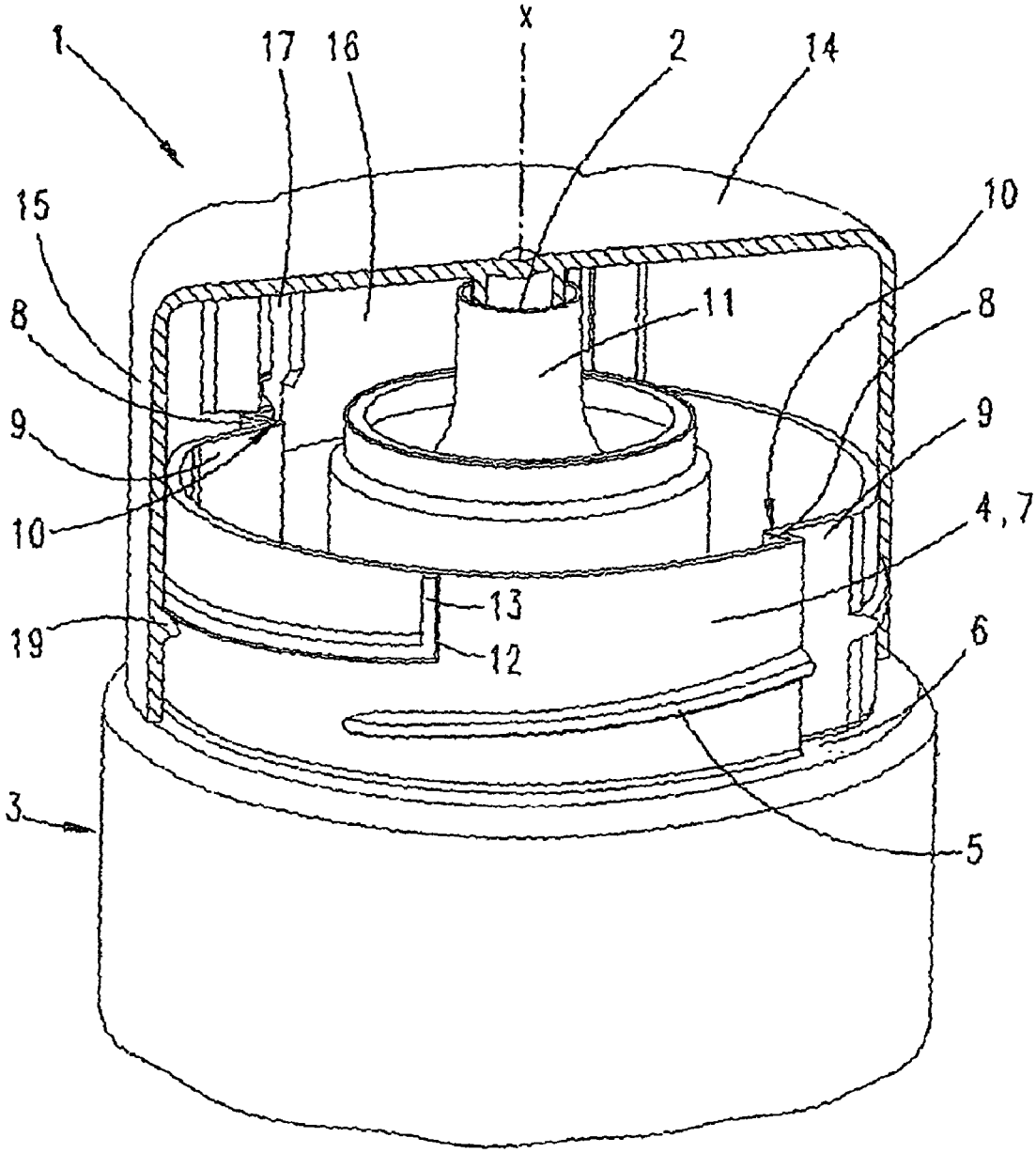
FIG. 6 shows the closure cap screw-connected to the container part, with the closure cap in a partially sectional illustration.
Figure 7:
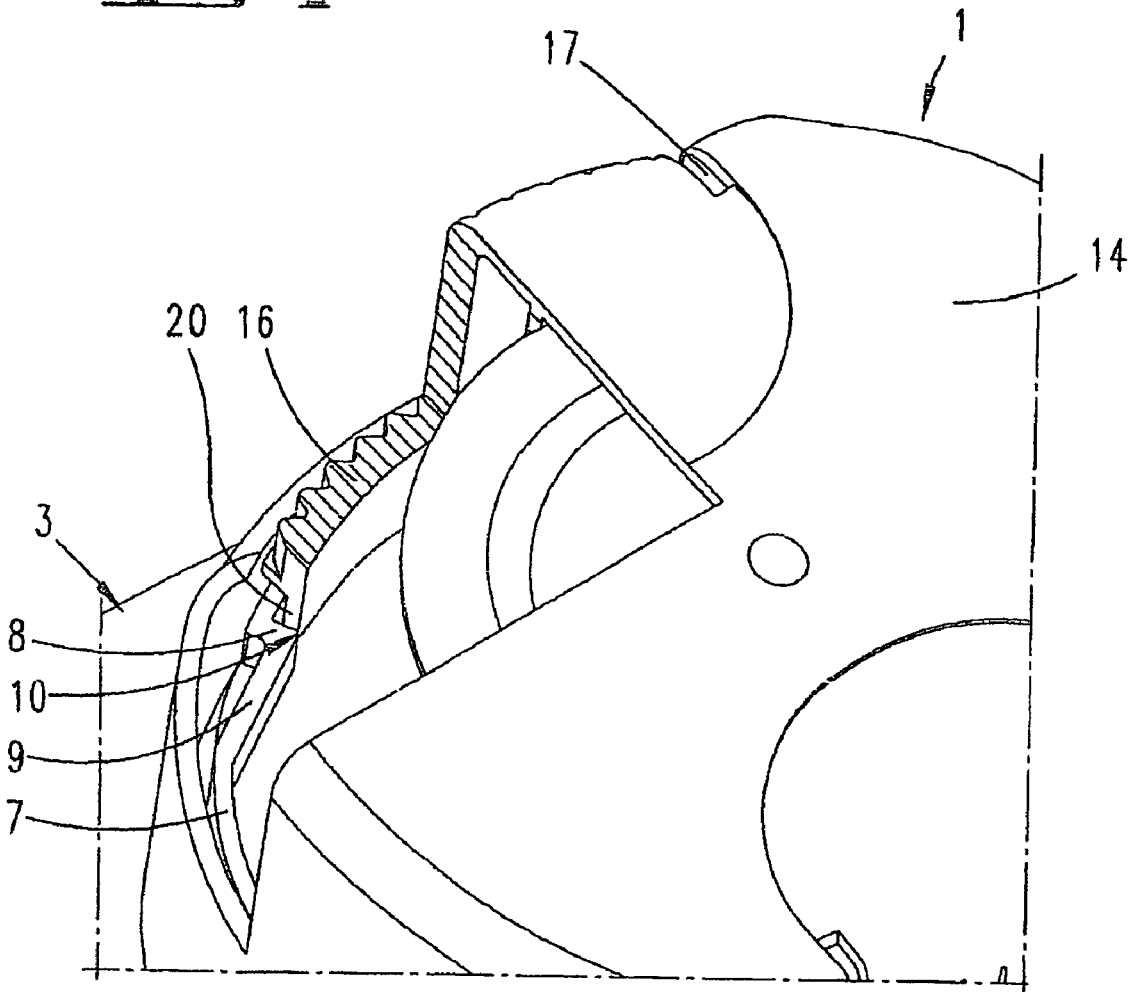
FIG. 7 shows a partially sectional perspective illustration of the closure-cap opening region.
Figure 8:
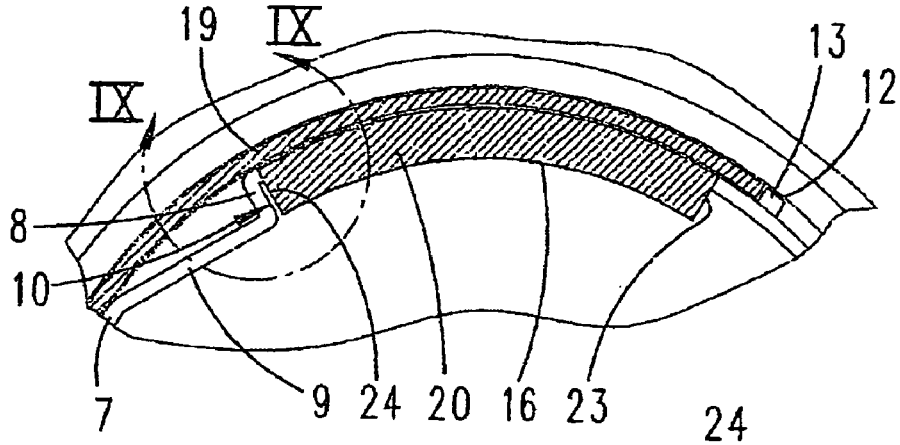

Irrespective of the configuration in each case, the external thread 5 has a screw-on rotary stop 12 in the form of a radially outwardly projecting stop shoulder 13 which extends parallel to the axis of rotation x on the container-part wall 4 or, in the case of the exemplary embodiment according to FIG. 6, on the annular wall 7.

This screw-on rotary stop 12 is offset at an angle of rotation behind the associated opposing protrusion 8, as seen in the screw-on direction, with the inclusion of an angle of approximately 60°, as seen in a vertical projection, between the opposing protrusion 8 and screw-on rotary stop 12. Corresponding to the provision of two opposing protrusions 8, two diametrically oppositely-disposed screw-on rotary stops 12 or stop shoulders 13 are also provided.

Figure 3:
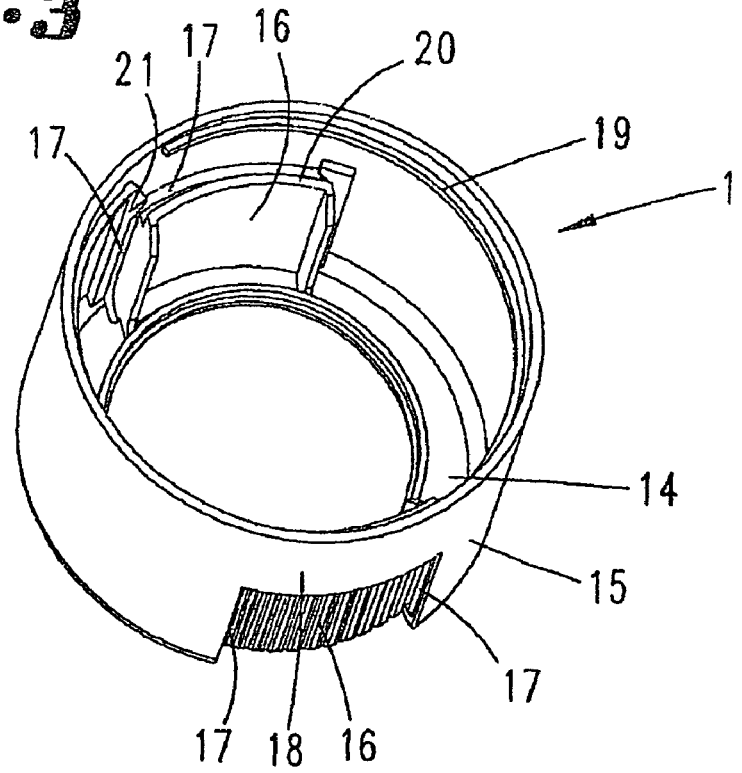
FIG. 3 shows the closure cap in a perspective view from below.

The closure cap 1 which is illustrated in an exemplary configuration in FIGS. 3 to 5 has a closure-cap top 14 and an encircling closure-cap wall 15. The closure-cap top 14 is provided on the inside with closure means (not illustrated more specifically), for example closure plugs for closing the mouth opening 2 in a sealing manner.

The closure cap 1 is provided with a number of actuating portions 16 of flap-like configuration which corresponds to the number of opposing protrusions 8 of the container part, that is to say, in the embodiments illustrated, with two diametrically opposite flap-like actuating portions 16. The latter are cut free on the closure cap 1, the cuts 17, which each bound a flap-like actuating portion 16 on three sides, extending as far as the closure-cap top 14. The flap-like actuating portion 16, which has an L-shaped cross-section, is rooted in this region of transition to the closure-cap top 14.

Starting from the closure-cap top 14, the flap-like actuating portions 16 extend over approximately two thirds of the closure-cap height and have a circumferential band 18 of the closure cap 1 gripping beneath them, this circumferential band having a threaded formation 19 in the form of an internal thread on the inside.

The circumferential band 18, outside the flap-like actuating portions, is an integral part of the closure-cap wall 15 and has the same diameter as the closure-cap wall 15. The flap-like actuating portions 16, in contrast, have a radial dimension which is smaller, for example by the extent of the wall height, than that of the closure-cap wall 15.

Each flap-like actuating portion 16 has, in the free foot region, a control portion 20 which is tapered in a step-like manner and, as seen in a projection onto the closure-cap wall 15, overlaps with the upper peripheral region of the circumferential band 18. The region with thicker material above this control portion 20 is exposed for actuation in the window-like cutout of the closure cap 1 and, for improved handling, is provided with a corrugated surface.

During the operation of screwing the closure cap 1 onto the container part 3, the tapered-material control portions 20 of the flap-like actuating portions 16 engage behind the annular wall 7 in the region of the container-part top 6, it being the case, during the screw-on rotary displacement, that the control portions 20 and thus the flap-like actuating portions 16, which overlap with the actuating-part wall or the annular wall 7 from above, are deflected radially inward via the run-on slopes 9 in the first instance in order finally, following passage over the opposing protrusions 8, to pivot back into their original position again on account of the resilient properties of the plastics material used. In this case, the control portions 20 pass with blocking action behind the opposing protrusions 8 of the container 3, this achieving a rotary block in the opening direction of the closure cap 1. Those flanks of the control portions 20 which correspond with the opposing protrusions 8 are oriented strictly radially counter to the opposing protrusions 8, this achieving a defined latching position from which automatic removal is not possible. Also in this position, a stopping crosspiece 21 of the internal thread 19 of the cap strikes against the screw-on rotary stop 12 of the container part 3, so that further rotation of the closure cap 1 is prevented. In this situation, the closure cap is rotationally secured in both directions.

The rotary blocking action thus achieved can only be overcome by virtue of the flap-like actuating portions 16 being pressed in radially in the direction of the axis of rotation x, the control portions 20 being displaced radially inward, counter to the resilient force of the material, to the extent where they can be guided by subsequent rotary displacement of the closure cap 1 via the opposing protrusions 8—when the radially inwardly acting pressure on the flap-like actuating portions 16 is maintained. The axial height of the opposing protrusions 8 or of the annular wall 7 is selected such that, by way of a predetermined thread pitch, free passage over these protrusions or the annular wall takes place during the next operation. Also conceivable in this respect is a slotted guide which, during rotation of the cap, retains the flap-like actuating portions 16, once directed inward, in the radially inward direction.

Figure 10:
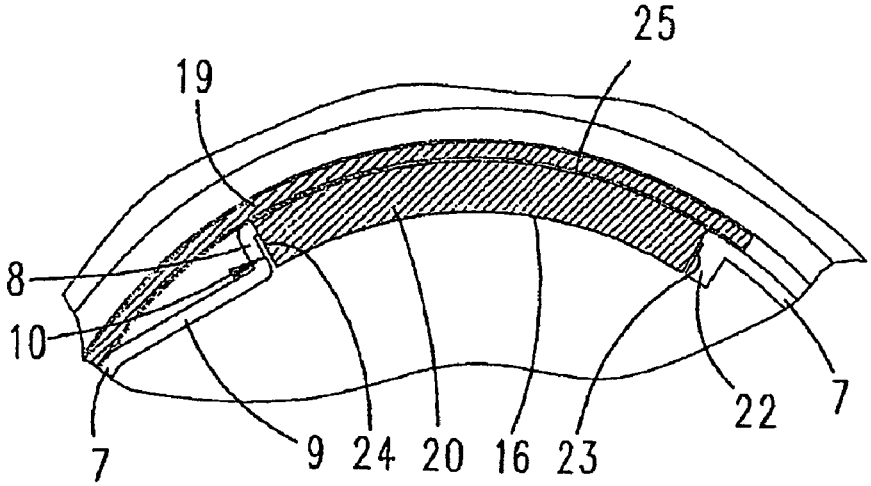
FIG. 10 shows a sectional illustration corresponding to FIG. 8, but this time relating to a second embodiment.

FIG. 10 illustrates an alternative configuration of the arrangement of a screw-on rotary stop 12. In contrast to the previously described exemplary embodiment, rather than being positioned in the region of the threaded formations, this rotary stop is in the form of a rotary-stop shoulder 22 which is formed from the annular wall 7, is oriented radially inward toward the axis of rotation x and interacts with a vertical surface 23 of the control portion 20 of the flap-like actuating portion 16, which vertical surface 23 is located opposite the vertical surface 24 which interacts with the opposing protrusion 8. As a result of this configuration, the control portion 20 of a flap-like actuating portion 16 is used not just for the rotary block which can be eliminated by two-fold actuation, but also for screw-on stop-limiting purposes. In the screwed-on position of the closure cap 1, the control portion 20 of a flap-like actuating portion 16 is arrested in a pocket 25 formed between the opposing protrusion 8 and the rotary-stop shoulder 22.

FIGS. 11 to 16 illustrate an embodiment which is manifested, in the first instance, in a double mouth 26 of the container 3. As can also be gathered from FIGS. 12 and 16, the container 3 is a double bottle with two separate chambers which are connected to one another merely via a connecting crosspiece 27. The connecting crosspiece 27 is drawn above the thread 5, which is formed on each sub-bottle, see FIG. 11.

Also provided is an additional part 28, which can be placed in position from above, overlapping the double mouth 26 on an individual basis in each case, and can also easily be removed in the upward direction. On account of the double mouth alone, however, the additional part 28 is rotationally secured once it has been placed in position.

With the exception of the special features which will be mentioned hereinbelow, the closure cap 1 is of substantially the same configuration as the closure cap, already described, of the other embodiments.

Once a closure cap 1 has been unscrewed, the additional part 28 can be removed without obstruction from the container or the double mouth 26 in the upward direction.

The thread 5 is formed in two portions, each associated with one of the abovementioned sub-containers, but basically in a circular outline in plan view, even though the mouths 26 can (only) be enclosed by a non-round enveloping surface. In the closed state, see FIG. 12, the closure cap 1, which engages beneath the threaded region, is seated on a shoulder of each of the sub-containers. An opening in the downward direction is provided in the region of the partition wall 27.

In its upper region, the closure cap 1, once again, has the already described flap-like actuating portions 16, separated out of the cap wall by cuts 17. Associated with a flap-like actuating portion 16 is a sunken wall portion or flattened wall portion 29, formed in the radial direction in each case.

Otherwise, the form of the cap continues undisturbed, with a circumferential band 18 continuing integrally beneath the flap-like actuating portion.

Figure 11:
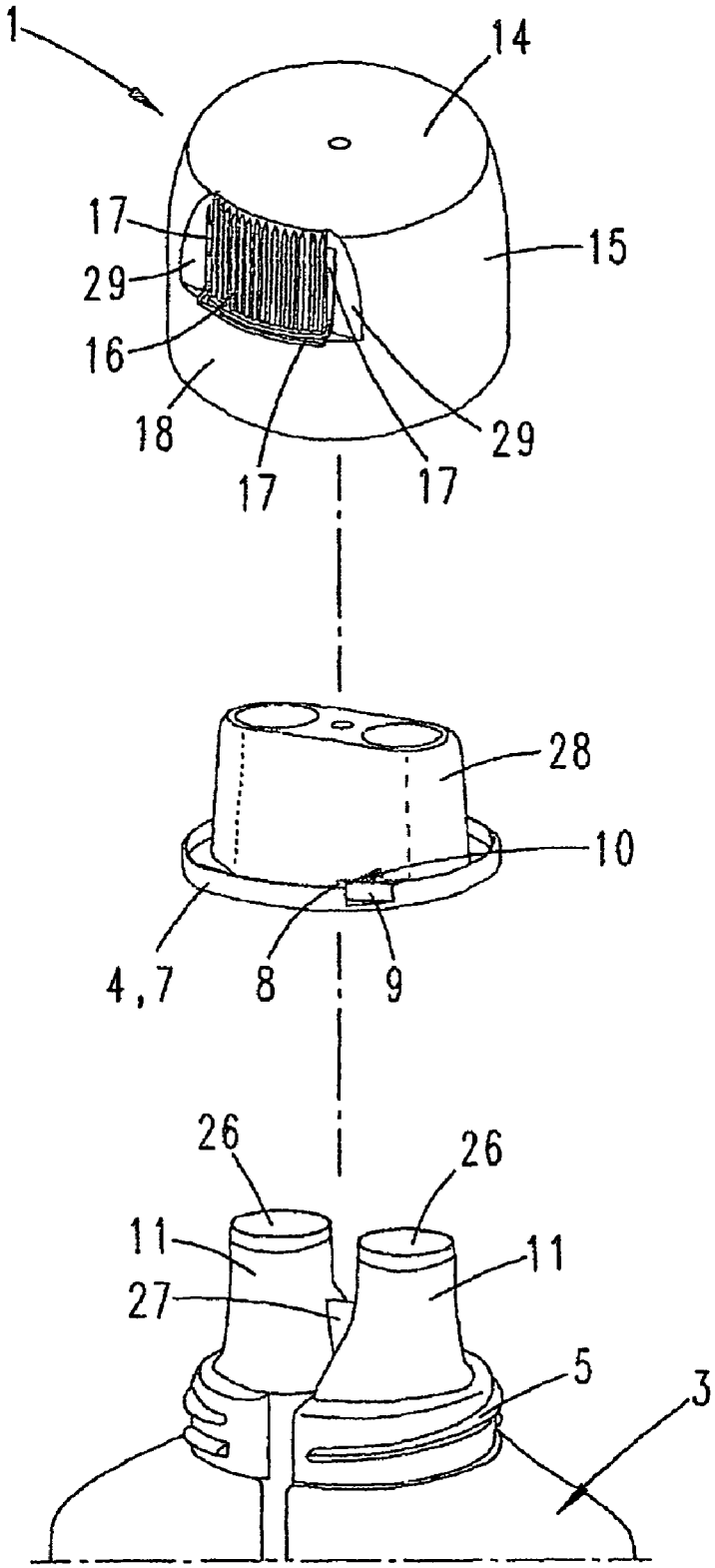
FIG. 11 shows an exploded illustration of a further embodiment, an additional part being proposed and a double mouth being formed on the container.
Figure 12:
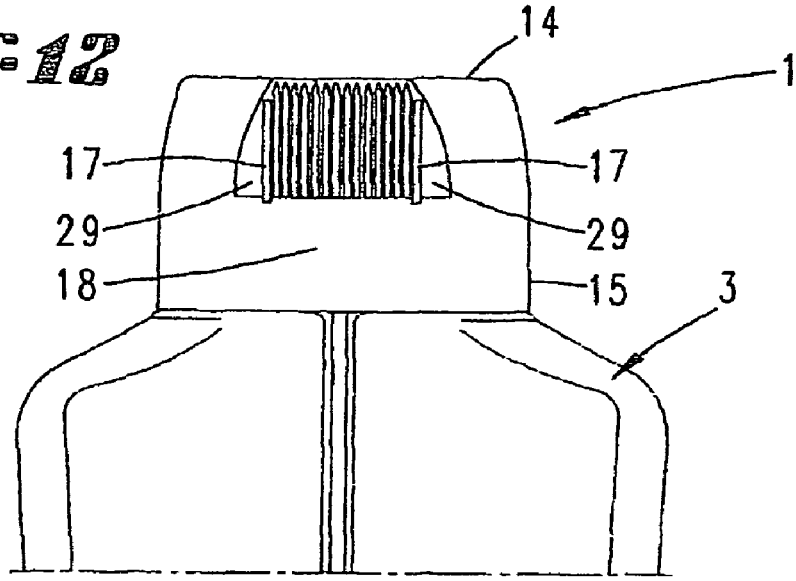
FIG. 12 shows the subject matter according to FIG. 11 in the closed state.
Figure 13:
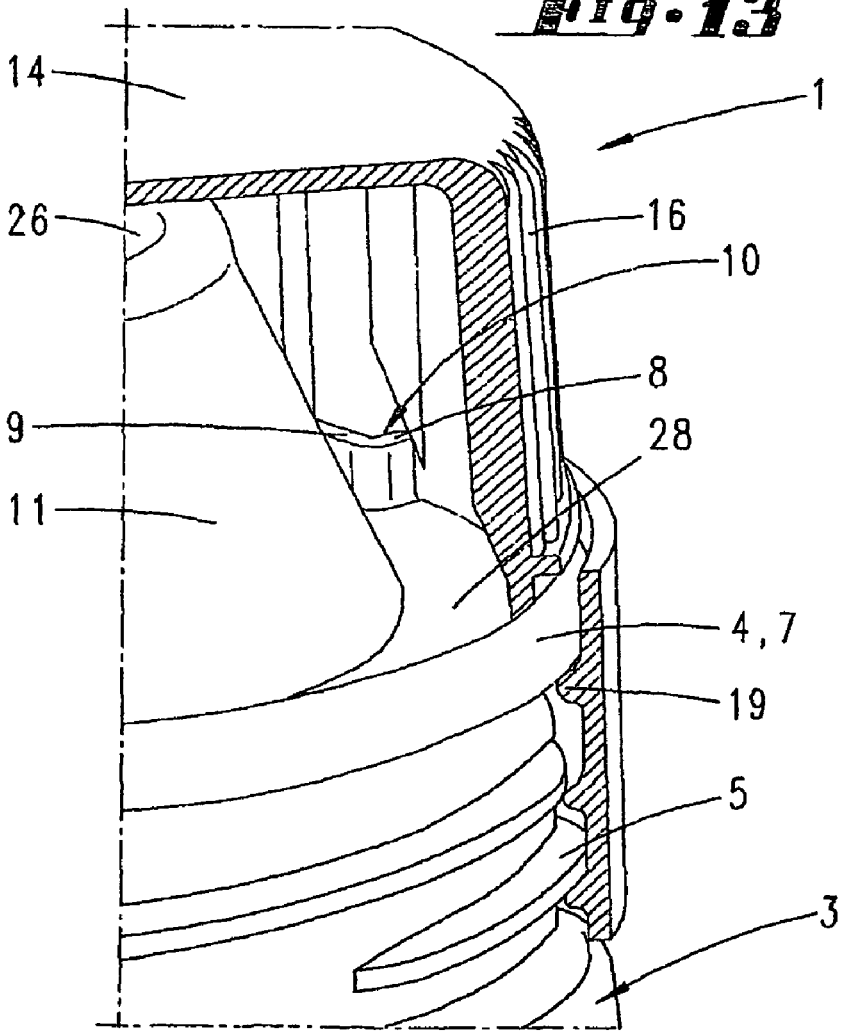
FIG. 13 shows the subject matter according to FIG. 12 with the closure cap in cross-section; the section being taken in the region of an actuating portion of flap-like shape.

As can be gathered from looking at FIGS. 11 and 13 together, the additional part 28, then, forms the actuating-part wall 4 or annular wall 7, although, in contrast to the previously explained embodiments, this actuating-part wall is now reduced to the shaping of the opposing protrusions 8 and run-on slope 9, etc. (this does not preclude the possibility, in a further embodiment (not illustrated), of the additional part 8 (also) forming the thread, for example if it is secured by latching on the container).

Otherwise the functioning is the same as has already been described in relation to the above embodiments. During the operation of screwing on the closure cap 1, the threaded engagement between the closure cap 1 and the container thread achieves clamping between the closure cap 1, the additional part 28 and the container 3. Despite the fact that the additional part 28 is only plugged on loosely, the closure cap 1 cannot be removed if the action of the opening-securing means has not been overcome, and the closure cap 1 unscrewed, in the specific manner required here.

Even if the closure cap 1 basically fully overlaps the additional part 28 in the closed state, this is not entirely the case in respect of the wall 4, 7 in the region of the flap-like actuating portions 16, as can be seen from FIG. 13 in particular.

Figure 14:
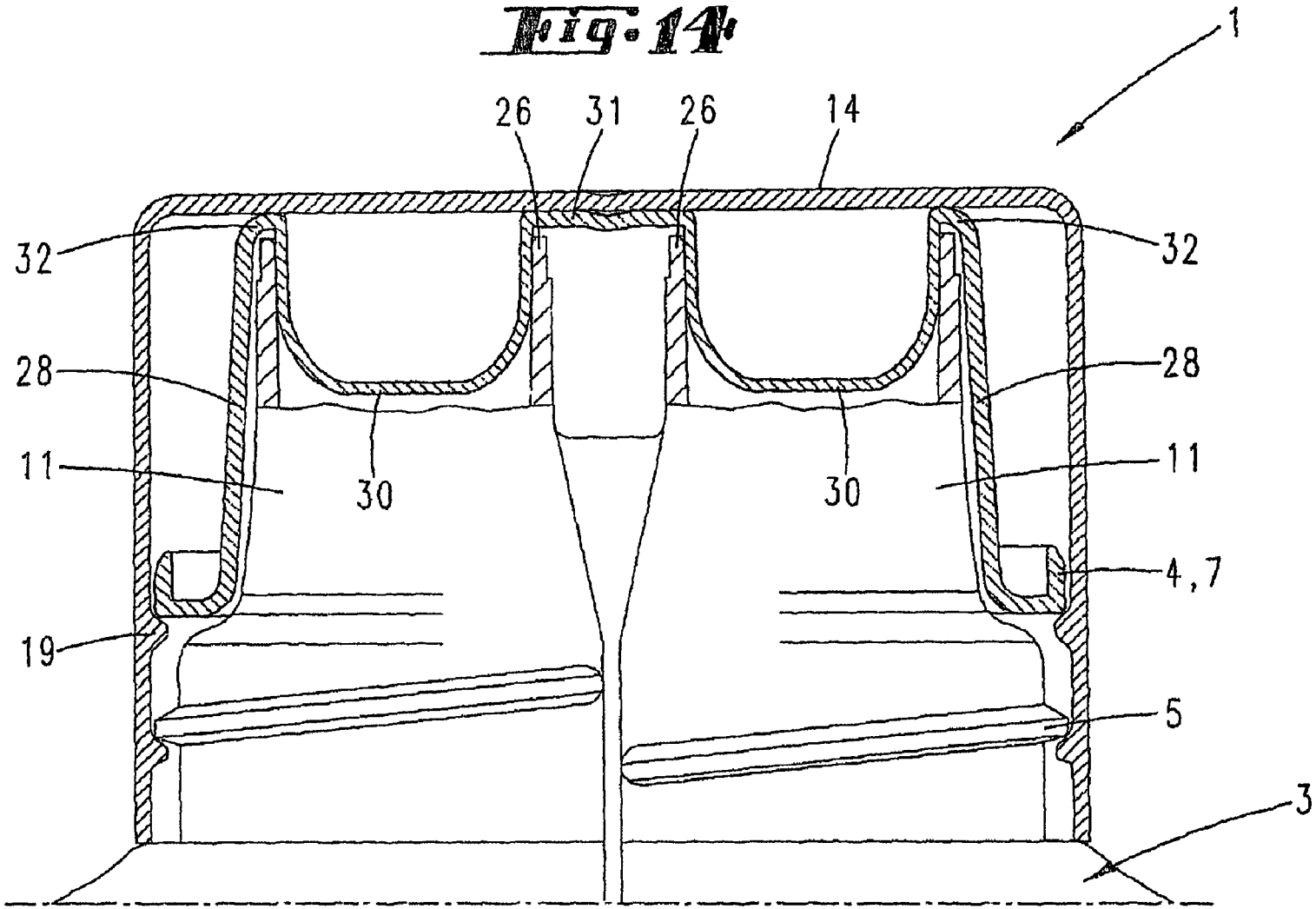
FIG. 14 shows a further cross-section through the subject matter according to FIG. 12, the section being taken outside the flap-like actuating portion.

The cross-sectional illustration according to FIG. 14, in contrast, shows full overlapping outside the closure flap-like portions 16.

It can also be gathered that the additional part 28 forms closure portions 30 which each project into the double mouth 26. These are of cup-like configuration and open outward in each case.

Figure 15:
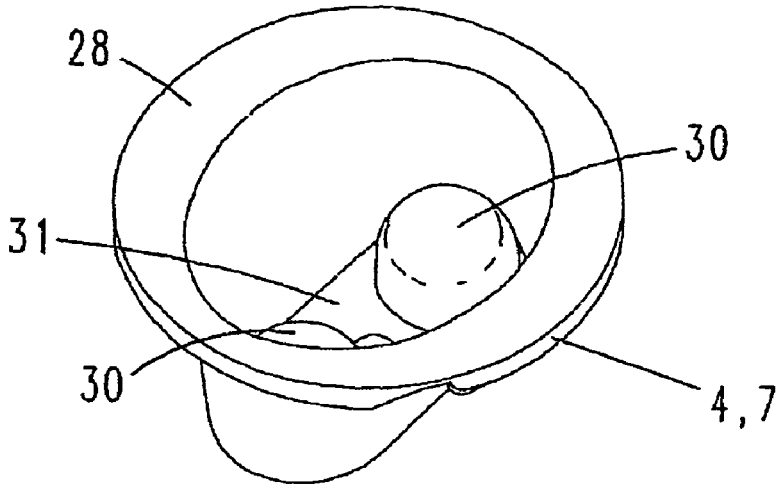
FIG. 15 shows the additional part in a perspective view from the bottom.
Figure 16:
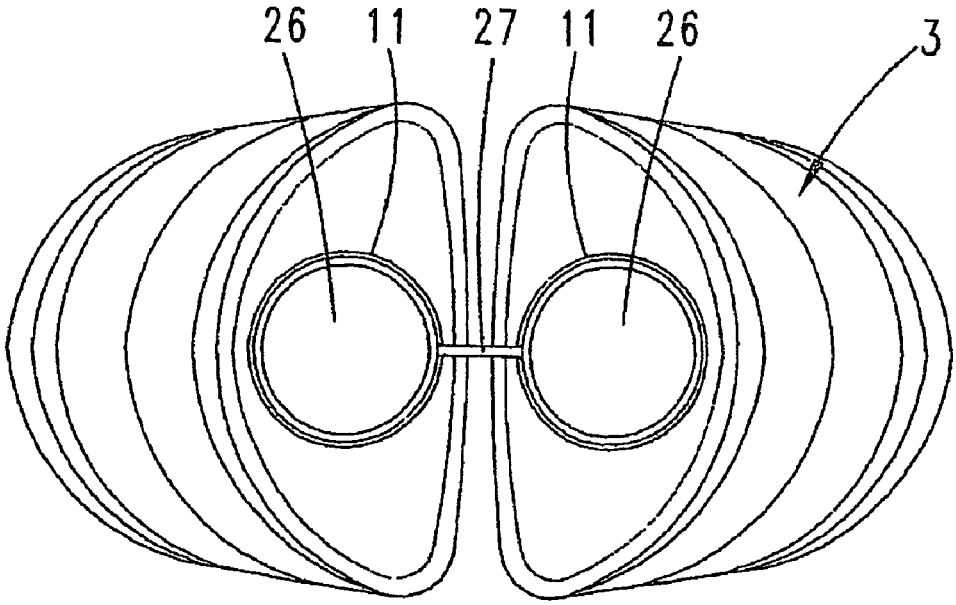
FIG. 16 shows the container in a view from the top, without a closure cap.
Figure 17:
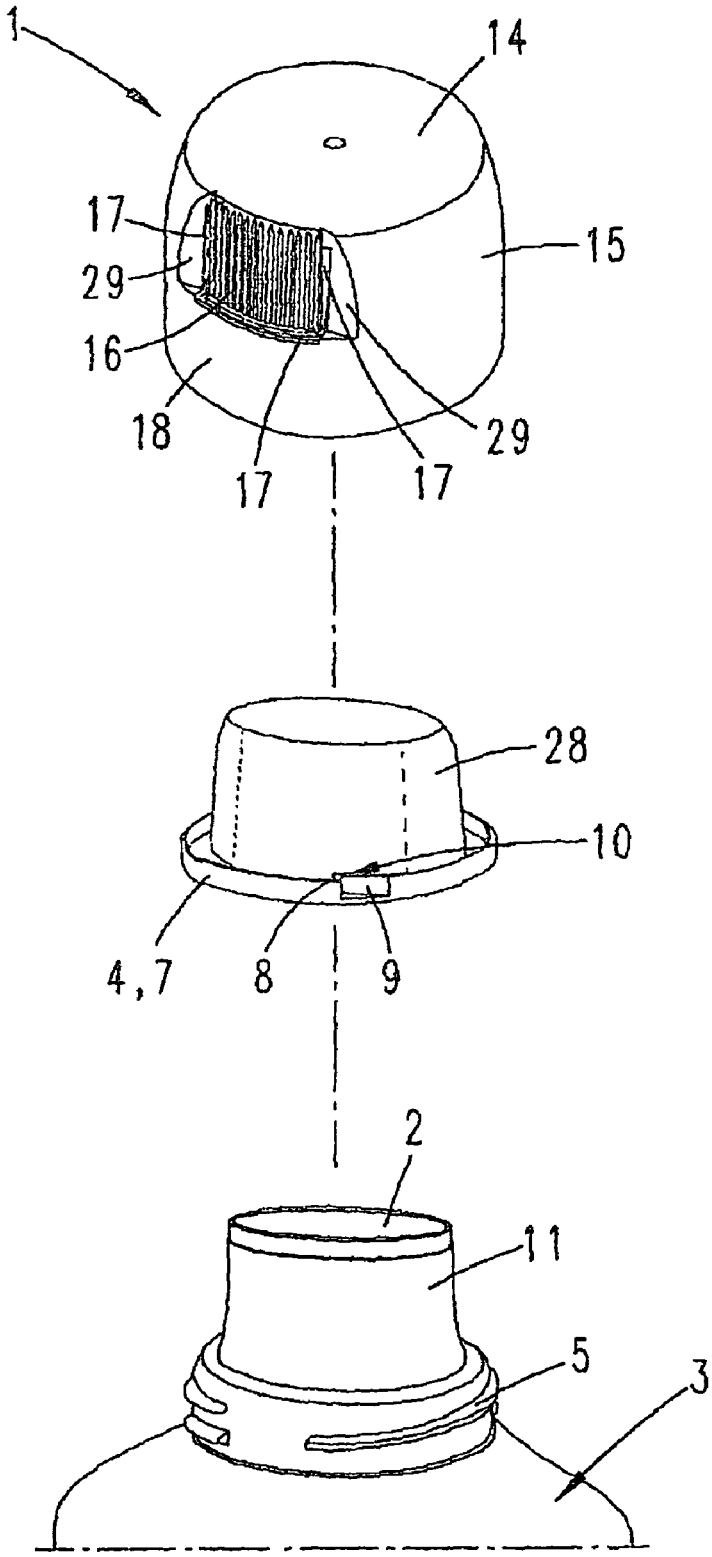
FIG. 17 shows an illustration according to FIG. 11 of a further embodiment with a non-round mouth on the container part.

These two closure portions 30 merge one inside the other via a central connecting portion 31, which can also be seen from FIG. 15.

In the closed state, the underside of the top of the closure cap 1 is seated directly on the connecting portion 31 or the peripheral portions 32, which are formed, as it were, by the cup peripheries of the cup-like closure portions 30.

FIGS. 17 to 20 illustrate a further embodiment, which corresponds to the previously described embodiment, although in this case (once again) only one mouth opening 2 is provided. This mouth opening 2, however, is of non-round configuration, as can be gathered, in particular, from the plan view of the container 3 according to FIG. 20. The exploded illustration according to FIG. 17 otherwise corresponds to the illustration according to FIG. 11, so that, for description purposes, you are basically referred to the description relating to FIG. 11.

Figure 18:
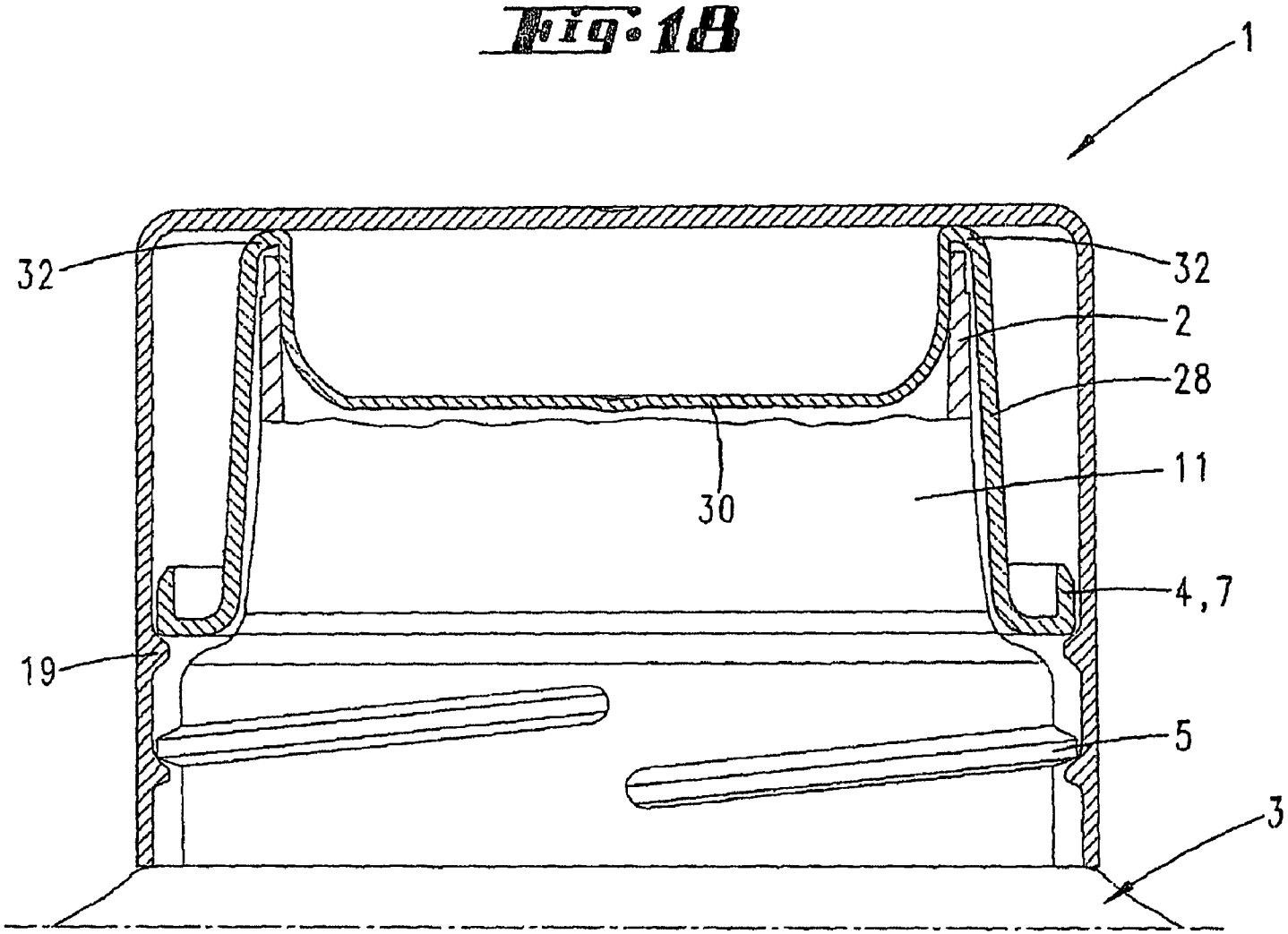
FIG. 18 shows a sectional illustration through the subject matter according to FIG. 17 in the closed state, the section being taken outside the flap-like actuating portion.
Figure 19:
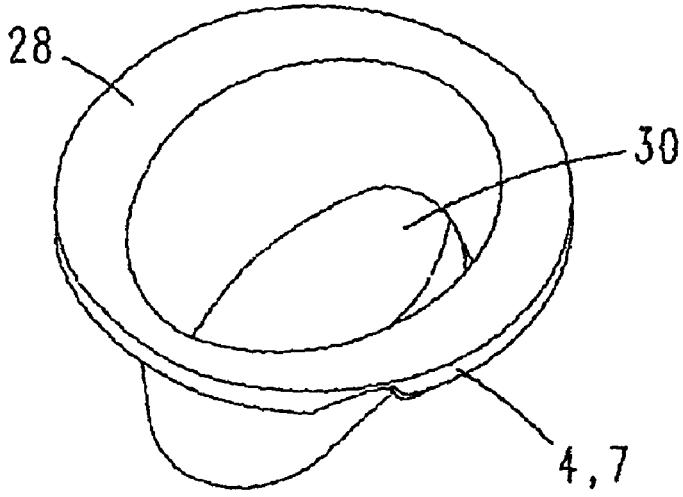
FIG. 19 shows an illustration of the additional part according to the subject matter of FIG. 17 in a perspective view from below.
Figure 20:
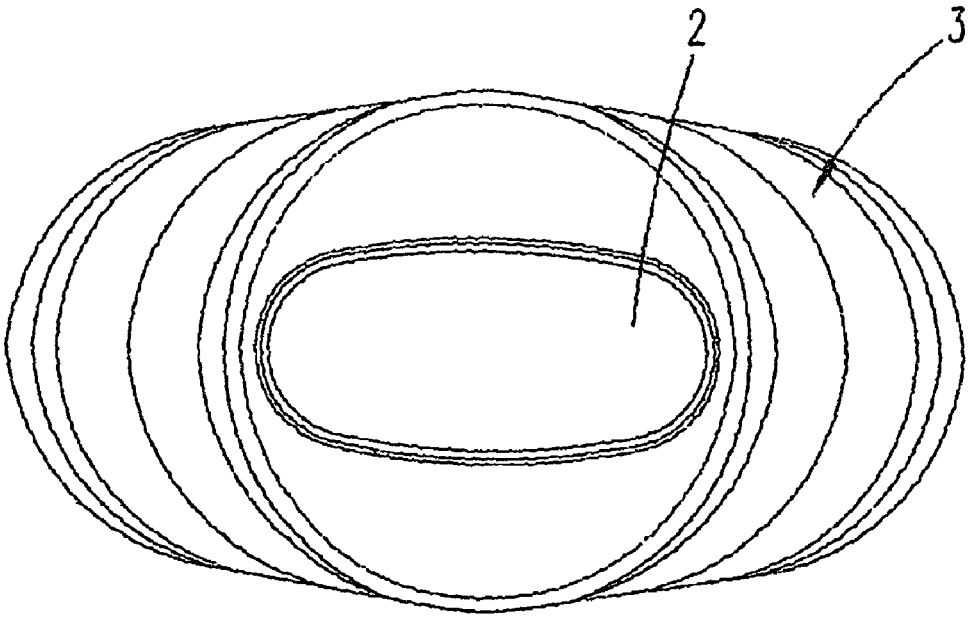
FIG. 20 shows a plan view of the mouth of the container according to the subject matter of FIG. 17.

The perspective view of the additional part 28 of this embodiment from the bottom shows, in particular, the closure portion 30, which, in addition, can also be gathered from the cross-sectional illustration according to FIG. 18.

All features disclosed are (in themselves) pertinent to the invention. The disclosure contents of the associated/attached priority documents (copy of the prior application) are hereby also included in full in the disclosure of the application, also for the purpose of incorporating features of these documents in claims of the present application.

What is claimed is:

1. Closure combination comprising a closure cap and a container part, which has a mouth opening, the closure cap being screw-connectable to the container part, and an opening-securing means which requires two-fold actuation being provided, such two-fold actuation involving first pressing an actuating flap inwardly and second turning the closure cap for unscrewing the closure cap, wherein an additional part associated with the mouth opening is provided, the additional part being rotationally secured on the mouth opening but otherwise being freely removable, such that once the closure cap has been unscrewed, the additional part can be removed without obstruction from the container and in that the opening-securing means is formed with interaction between the closure cap and the additional part, wherein the additional part is configured for plug-on engagement over the mouth opening and a thread-free neck portion beneath the mouth opening in the downward direction, wherein further the threaded engagement between the closure cap and the container thread achieves clamping between the closure cap, the additional part and the container, such that even though the additional part is only plugged on loosely, the closure cap cannot be removed if the action of the opening-securing means has not been overcome, keeping the closure cap unscrewed.

2. Closure combination according to claim 1, characterized in that the closure cap comprises injection molded plastic.

3. Closure combination according to claim 1, characterized in that the container part comprises a plastic material.

4. Closure combination according to claim 1, further comprising an opposing protrusion formed on the additional part, said opposing protrusion extending perpendicularly to the plane of the container-part top.

5. Closure combination comprising a closure cap and a container part, which has a mouth opening, the closure cap being screw-connectable to the container part, and an opening-securing means which requires two-fold actuation being provided, such two-fold actuation involving first pressing an actuating flap inwardly and second turning the closure cap for unscrewing the closure cap, characterized in that the opening-securing means comprises an actuating flap, which has a rotary block and is cut free on the closure cap, and an opposing protrusion when the actuating flap is pressed radially inwardly and which is formed above the mating thread formed on the container part, wherein the opposing protrusion is formed on an additional part associated with the mouth opening, characterized in that the additional part is a closure part for the mouth, and wherein the additional part is configured for plug-on engagement over the mouth opening and a thread-free neck portion beneath the mouth opening in the downward direction.

6. Closure combination according to claim 5, characterized in that the additional part is U-shaped in a cross section with horizontal flange, outwardly directed, on the free end of the U-legs.

7. Closure combination according to claim 5, characterized in that the additional part has a closure portion which, engaging in the mouth opening from above, runs beneath a mouth plane.

* * * * *